US010463893B2

(12) United States Patent
Koch et al.

(10) Patent No.: US 10,463,893 B2
(45) Date of Patent: Nov. 5, 2019

(54) COOLING DEVICE FOR A PROTECTIVE RESPIRATORY APPARATUS

(71) Applicant: Dräger Safety AG & Co. KGaA, Lübeck (DE)

(72) Inventors: Jochim Koch, Ratzeburg (DE); Carsten Stemich, Ratzeburg (DE); Bastian Wilke, Lübeck (DE); Christian Ulbrich, Hamburg (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 796 days.

(21) Appl. No.: 15/027,320

(22) PCT Filed: Oct. 1, 2014

(86) PCT No.: PCT/EP2014/002667
§ 371 (c)(1),
(2) Date: Apr. 5, 2016

(87) PCT Pub. No.: WO2015/051890
PCT Pub. Date: Apr. 16, 2015

(65) Prior Publication Data

US 2016/0250504 A1 Sep. 1, 2016

(30) Foreign Application Priority Data

Oct. 7, 2013 (DE) ..... 10 2013 016 601

(51) Int. Cl.
*A62B 9/00* (2006.01)
*A62B 7/02* (2006.01)

(52) U.S. Cl.
CPC ..... *A62B 9/003* (2013.01); *A62B 7/02* (2013.01)

(58) Field of Classification Search
CPC .. A61M 16/10; A61M 16/1075; A61M 16/22; A61M 16/0078; A61M 16/0045;
(Continued)

(56) References Cited

U.S. PATENT DOCUMENTS 4,188,947 A * 2/1980 Pasternack ..... A62B 9/003 128/202.26
4,635,629 A * 1/1987 Thorp ..... B63C 11/24 128/202.26

(Continued)

FOREIGN PATENT DOCUMENTS

DE 40 05 720 C1 8/1991
DE 4005720 C1 * 8/1991 ..... A62B 7/10

(Continued)

*Primary Examiner* — Justine R Yu
*Assistant Examiner* — Matthew R Moon
(74) *Attorney, Agent, or Firm* — McGlew and Tuttle, P.C.

(57) ABSTRACT

A cooling device (10), for a protective respiratory apparatus (100), has a housing (20), a breathing bag (30) arranged in the housing (20) with an inlet (32) for respiratory air (A) and an outlet (34) for cooled respiratory air (A) and a spring plate (40) with a spring device (42) to apply a spring force to the breathing bag (30). Between the housing (20) and at least one section of an outer side (36) of the breathing bag (30) an cooling air channel (50) is formed. The cooling air channel (50) is connected to the ambient air (U) outside the housing (20) in a fluid-communicating manner. A blower (52) is arranged for the generation of a flow of the ambient air (U) through the cooling air channel (50). Furthermore a protective respiratory apparatus (100) having such a cooling device is provided.

19 Claims, 4 Drawing Sheets

(58) Field of Classification Search
CPC ..... A61M 16/0063–0069; A61M 16/0075; A61M 16/0081; A61M 16/08; A61M 16/0883; A61M 16/108–1095; A61M 16/12–125; A61M 2205/33; A61M 2205/3303; A61M 2205/3368; A61M 2205/36; A61M 2205/3606; A62B 7/02; A62B 9/003; F28D 9/0087; F28F 2255/02
USPC ..... 165/46
See application file for complete search history.

(56) References Cited

U.S. PATENT DOCUMENTS 4,821,711 A * 4/1989 Eckstein ..... A62B 7/08 128/202.26
5,048,517 A * 9/1991 Pasternack ..... A62B 7/08 128/202.26
5,072,728 A * 12/1991 Pasternack ..... A62B 7/10 128/204.18
5,577,498 A * 11/1996 Yoshida ..... A62B 19/00 128/201.27
5,761,909 A * 6/1998 Hughes ..... A62B 9/003 165/DIG. 9
8,741,220 B2 * 6/2014 O'Donnell ..... A61L 2/06 422/120
8,746,245 B2 * 6/2014 Koch ..... A61M 16/1075 128/204.15
9,950,196 B2 * 4/2018 Koch ..... A62B 7/00
2004/0182394 A1 * 9/2004 Alvey ..... A62B 7/02 128/205.22
2005/0197684 A1 * 9/2005 Koch ..... A41D 13/002 607/104
2009/0260137 A1 * 10/2009 Koch ..... A62B 17/005 2/456
2012/0138051 A1 * 6/2012 Curran ..... A62B 7/10 128/201.25
2014/0041662 A1 * 2/2014 Almqvist ..... A61M 16/0045 128/204.23

FOREIGN PATENT DOCUMENTS

DE 10 2008 055 700 B4 2/2013
EP 2 374 509 A1 10/2011
FR 1 336 301 A 8/1963
GB 724801 A * 2/1955 ..... A61M 16/00
GB 2 095 120 A 9/1982
GB 2 200 289 A 8/1988

* cited by examiner

COOLING DEVICE FOR A PROTECTIVE RESPIRATORY APPARATUS

CROSS REFERENCE TO RELATED APPLICATIONS

This application is a United States National Phase Application of International Application PCT/EP2014/002667 filed Oct. 1, 2014 and claims the benefit of priority under 35 U.S.C. § 119 of German Patent Application 10 2013 016 601.2 filed Oct. 7, 2013 the entire contents of which are incorporated herein by reference.

FIELD OF THE INVENTION

The present invention relates to a cooling device for a protective respiratory apparatus and also to a protective respiratory apparatus for the respiration of a person.

BACKGROUND OF THE INVENTION

Protective respiratory apparatuses for people are known in principle. They are used, for example, to supply relief forces in emergencies with atmospheric oxygen and corresponding respiratory air. Such protective respiratory apparatuses are, for example, portable systems so that relief forces, for example fire fighters, are supplied with respiratory air even in difficult and adverse ambient conditions.

DE 10 2008 055 700 B4, for example, presents such a protective respiratory apparatus.

It is also known that a respiratory circuit is provided in the case of such protective respiratory apparatuses so that the expired respiratory air at least in part is provided again for the respiratory air that is to be inspired.

In order to be able to guarantee a sufficient vital function for the person, in this connection usually a regeneration step occurs in which $CO_2$ is extracted from the expired respiratory air (for example by absorption).

Subsequently, oxygen from an oxygen reservoir is admixed in order to maintain a sufficient proportion of oxygen in the respiratory air.

The disadvantage of the known solutions for protective respiratory apparatuses is that the respiratory air registers a rise in temperature during use. This is based in particular on the fact that the extraction of $CO_2$, for example by means of an absorption step, results in the respiratory air being heated up as a consequence. This is usually accompanied with a loading of the respiratory air with moisture so that the respiratory air exits known respiratory-air regenerators in a state in which it is heated up and usually saturated with water. Since the respiratory air is guided in a circuit, this would result in an increase in temperature of the respiratory air which is very unpleasant for the user of the protective respiratory apparatus.

In the case of known protective respiratory apparatuses therefore usually a cooling device is used, as it is described, for example, in DE 10 2008 055 700 B4.

Such cooling devices are very expensive and complex to produce and in addition require structural space and also corresponding materials, as a result of which the weight and the volume of the protective respiratory apparatus are increased in an undesirable manner.

Known cooling devices in the form of ice coolers have little flexibility, however, with regard to their variability and their adaptation. The service life of such ice coolers is also limited to the corresponding melting time of the ice arranged therein.

SUMMARY OF THE INVENTION

It is an object of the present invention to eliminate, at least in part, the disadvantages that have been described above. In particular, it is an object of the present invention to improve the cooling capacity for the respiratory air in a protective respiratory apparatus in a cost-effective and simple manner.

The object stated above is achieved by means of a cooling device having the features according to the invention. In this connection, features and details that are described in conjunction with the cooling device in accordance with the invention of course also hold good in conjunction with the protective respiratory apparatus in accordance with the invention and in each case vice versa so that reference is or can be always made reciprocally with regard to the disclosure with respect to the individual aspects of the invention.

In accordance with the invention, the cooling device is provided for a protective respiratory apparatus. For this, the cooling device has a housing, a respiratory bag (breathing bag), arranged in the housing, with an inlet for respiratory air and an outlet for cooled respiratory air and also preferably a spring plate. The spring plate is equipped with a spring device to apply a spring force to the respiratory bag. The spring plate in a protective respiratory apparatus is often also referred to as a respiratory-bag plate or breathing bag plate.

A cooling device in accordance with the invention is distinguished in that formed between the housing and at least one section of an outer side of the respiratory bag (breathing bag) there is a ventilating channel (cooling air duct). In this connection, the cooling air duct is connected to the ambient air outside the housing in a fluid-communicating manner. This is to be understood in that the cooling air duct is formed and/or arranged in such a way that ambient air can get into the cooling air duct. Furthermore, a ventilator (blower, blower fan) is arranged for the generation of a flow of the ambient air into and/or through the cooling air duct.

In accordance with the invention, the cooling device is thus used to cool the respiratory air within a respiratory-air circuit in a protective respiratory apparatus. Known protective respiratory apparatuses usually have a respiratory bag which can be understood to be a pneumatic abutment for the lung function (exchange of air) of the user. The respiratory-air circuit is provided by the inspiration and expiration of air by the person. In other words, upon expiration corresponding expired respiratory air is pushed by the person into the respiratory-air circuit, thereby the air passes the respiratory-air regenerator and reaches the respiratory bag. With an increase in the spring force and tension of the spring device, the volume of the respiratory bag is increased, so that in this case the abutment is provided for the pneumatic function of the lungs of the wearer. During the next step of inspiration by the person, the volume within the respiratory bag is reduced again so that accordingly the spring device can also relax in part.

This circuit is used for additional cooling capacity. Thus, usually the air enters the respiratory bag in a state in which it is warmed and often also saturated relative to the water content. The outer sides of the respiratory bag are now used in a manner in accordance with the invention as condensation surfaces for the transmission of heat to the ambient air. In order to be able to guarantee this, a flow for the ambient air is provided by means of a blower on the outside of the respiratory bag. The blower is able to guarantee that the ambient air is drawn in by suction from outside the housing and accordingly provide transportation of the ambient air through the cooling air duct. In other words, the blower ensures that a corresponding volume flow of ambient air sweeps past at least a section of the outer side of the respiratory bag. This contacting of the outer side of the respiratory bag leads to a situation where as a result of the flow continuously fresh ambient air and accordingly ambient air that is substantially at a constant temperature is in contact with the outer side of the respiratory bag. As a result of transportation of heat from the inside of the respiratory bag, corresponding transportation of heat away from the respiratory air located therein can be provided by this. In addition to pure heat-transportation, in this case it is of crucial significance that condensation can also take place on the inside of the respiratory bag for the respiratory air. In the case of the condensation, the so-called condensation enthalpy is released, as a result of which transmission of the corresponding energy as heat to the ambient air can take place on the outer side of the respiratory bag. In this way, it is possible to provide an additional cooling effect for the respiratory air. It is, however, to be pointed out that as a result of the flow along the outer side of the respiratory bag even without condensation on the inside of the respiratory bag for the moisture contained in the respiratory air corresponding cooling capacity can be provided. In comparison with known cooling devices, in this way cooling can be effected at a system that is already present or at a component of the protective respiratory apparatus that is already present. If a respiratory-air circuit is provided, usually a respiratory bag is present. In a manner in accordance with the invention, the respiratory bag is now set up to form a cooling device so that here a cooling capacity can already be provided.

An alternative configuration of the respiratory bag with a substantially flat or planar shaping renders possible an increase in the potential convection surface and, if applicable, an optimization of the pressure loss of the secondary cooling flow. Of course, it is possible to combine a cooling device in accordance with the invention with cooling devices that are already known, for example the ice cooler described in the introduction. It thus becomes possible to provide intensified cooling capacity without increasing the structural space and the weight of the protective respiratory apparatus. Depending on individual situations, a cooling device in accordance with the invention can also suffice as a sole cooling device. In this case, in comparison with known cooling devices, even a reduction in weight and a reduction in the structural volume can be attained.

A further advantage is that the blower can of course be formed so that it can be controlled or even regulated. Thus, it becomes possible to vary the volume flow along the outer side of the respiratory bag and adapt it according to the individual situation. The greater the volume flow is designed to be in principle, the greater also is the cooling capacity that is provided by the cooling device in accordance with the invention. Thus, in a manner in accordance with the invention, it is possible to effect control or even regulation of the cooling capacity and thus in an indirect manner an influence on the desired temperature of the respiratory air that is to be inspired. The flexibility of a cooling device in accordance with the invention in use can as a result be significantly increased.

It is to be pointed out, furthermore, that the cooling air duct does not have to have its own walls. On the contrary, the cooling air duct is already constituted in terms of its functionality by the corresponding limitation on the one side by means of the housing of the cooling device and on the other side by means of the corresponding section of the respiratory bag. The cooling air duct can of course also be formed so as to be longer and, for example, have sections between a cooling plate and the housing. Separate air inlets and air outlets for the corresponding fluid-communicating connection are also possible within the scope of the present invention. In this connection, it suffices if one single air inlet and preferably also one single air outlet are provided for the cooling air duct in order to produce the fluid-communicating connection with the ambient air so that ambient air can reach the cooling air duct.

It can be advantageous if in the case of a cooling device in accordance with the invention at least one flow-directing element is arranged in the cooling air duct for the targeted influence on the direction of flow of the ambient air in the cooling air duct. What it is to be understood by this is a mechanical installation situation in which an oncoming flow with the ambient air against the flow-directing element leads to a change in the direction of flow of the ambient air in the cooling air duct. For this, the flow-directing elements can be formed, for example, as a directing sheet or directing surfaces or as directing ribs. The contour of the respective flow-directing element is then adapted to the desired direction of flow and can have both straight and curved surfaces. For example, it is thus possible to provide uniform distribution of the ambient air within the cooling air duct or to different sections and sides of the cooling air duct. Furthermore, it is possible to influence the type of flow so that deliberately sections having a laminar flow and other sections having a deliberately turbulent flow can be provided for the ambient air. As a function of the kind of flow, accordingly adaptation of the dwell time in the respective place within the cooling air duct can also be provided. If the dwell time is increased, this can result in a change in the cooling capacity taking place. An increase in the flow with a reduced dwell time at the respective section of the respiratory bag can, however, also result in the maximum temperature difference always being provided for the desired removal of heat so that in such a case the cooling capacity is maximized.

A further advantage can be attained if in the case of a cooling device in accordance with the invention there is arranged in the housing a cooling plate which is formed as a holding element or an abutment for the respiratory bag to which the spring force is applied by way of the spring plate. The cooling plate has in this connection a geometrical extent which, with regard to cooling plate outer edges, preferably protrudes at least in part beyond the geometrical extent of the opposing spring plate. Thus, it becomes possible for the spring plate to dip, so to speak, into the respiratory bag and for side sections of the respiratory bag to remain unaffected by the spring plate. This results in the lateral sections of the respiratory bag having as a result of the correlation between the spring plate and cooling plate, so to speak independently of the spring situation of the spring device, the same or substantially the same geometrical state of developed shaping. In other words, when the spring device springs out in the event of the reduction of the volume of the respiratory bag, the respiratory air located therein is pressed in the direction of the lateral outer side of the respiratory bag. This leads to a situation where substantially irrespective of the spring situation of the spring device and thus irrespective of the current respiratory situation the desired cooling capacity can be provided. In addition, the cooling plate is preferably arranged so that the cooling plate is parallel to or substantially parallel to the spring plate. The cooling plate can in addition be used for additional cooling or for additional targeted heat-transmission. Possibilities for this, which can be employed in particular for the bearing property for flow-directing elements relative to the cooling plate, are described, furthermore, later.

It can be advantageous if in the case of a cooling device in accordance with the paragraph above, the cooling plate has at least one flow-directing element for the targeted influence on the direction of flow of the ambient air in the cooling air duct. As has already been explained, flow-directing elements are to be advantageously adapted or improved with respect to cooling capacity. The use of a cooling plate now permits an explicit arrangement of the flow-directing element to be made possible within the cooling air duct. In this connection, the cooling plate is provided with such flow-directing elements in, for example, rib form. The cooling plate thus preferably forms a wall portion of the cooling air duct at this section of the cooling air duct. For example, by way of the cooling channel with corresponding flow-directing elements it is possible for a substantially star-shaped distribution to be effected outwardly to the lateral sections of the cooling air duct and thus to the outer side of the respiratory bag.

It is advantageous in addition if in the case of a cooling device in accordance with the invention in accordance with the two paragraphs above the cooling plate touches in a heat-transmitting manner (is in heat transfer contact with) a section on the outer side of the respiratory bag and in particular has at least one cooling rib for the enlargement of the surface of contact with the ambient air in the cooling air duct. In other words, the cooling plate is also used in this way for heat-transmission from the inside of the respiratory bag and thus from the respiratory air to the ambient air. For good utilization of the cooling effect of the cooling plate, the plate is preferably made from a material with high thermal conductivity, for example metal or metallized plastics material, because as a result homogenization of the temperatures can be attained. The contacting can be effected, for example, by means of the contact-pressing with the aid of the spring device by means of the spring plate. The increased internal pressure with respect to the environment in the respiratory bag likewise results in the respiratory bag being brought to lie against the cooling plate. Substance-locking or force-locking connections between the cooling plate and the respiratory bag are also possible within the meaning of the present invention.

For example, an adhesive can be used in order to guarantee the contact possibility for the heat-transmission. In addition, it is possible to improve the cooling plate with the cooling rib with regard to an enlargement in the surface of contact with respect to the ambient air. The greater the corresponding surface of the cooling plate is that is provided, the better the heat-transmission is that takes place so that the cooling capacity can be intensified over a greater surface.

Alternatively, in a further embodiment of the protective respiratory apparatus the spring plate or the cooling plate can be constructed so as to be integrated into the respiratory bag as a substantially fixed upper plate. In a further embodiment of the protective respiratory apparatus a substantially fixed lower base plate can be integrated into the respiratory bag. The integrated spring plate, the integrated cooling plate and also the integrated base plate then take on a sealing function and in this way have a direct contact with the respiratory gas or with the respiratory air in the respiratory bag.

Problems of heat-transmission at contact faces between the spring plate or the cooling plate and the respiratory bag or the material of the respiratory bag are reduced in this way. The reduction in the problems of heat-transmission substantially follows as a result of the integration of the spring plate, cooling plate or base plate, since as a result otherwise existing air cushions between the spring plate, cooling plate or base plate and respiratory bag, which are disadvantageous for good heat-transmission, can be avoided in a construction-related manner between the respiratory bag and spring plate, cooling plate or base plate. The meandering or undulating shaping is also particularly advantageous, as a result of the enlargement of the surface taking part in the heat exchange, for improving the heat exchange in the interior of the respiratory bag and also on the outer side of the respiratory bag. The side regions of the respiratory bag are constructed from flexible materials, such as, for example, textiles or plastics materials (elastomers), which are folded together with each breath and seal the respiratory bag on the upper and lower side of the respiratory bag towards the integrated base plate, the integrated spring plate or the integrated cooling plate.

Furthermore, in the respiratory bag, in particular in the region of the spring plate, cooling plate or base plate, further structural elements can be formed that enlarge the heat-conducting surfaces in the respiratory bag and thus improve the heat exchange and prevent an adhesion of the side regions of the respiratory bag together or to the spring plate, the cooling plate or the base plate. An increase in the surface with a simultaneous increase in the rigidity of the spring plate, cooling plate or base plate can be achieved advantageously by substantially configuring the cooling plate with a meandering or undulating shaping.

A further advantage can be attained if, in the case of a cooling device in accordance with the invention, the cooling plate has at least one cooling opening which opens the cooling air duct towards an outer side of the respiratory bag. Preferably, a plurality of cooling openings is provided. For example, the cooling plate can also be perforated and thus be formed substantially exclusively from cooling openings with connecting elements lying in between. Thus, the cooling plate is, so to speak, an aerated cooling plate so that the cooling effect can also be further improved on this side of the respiratory bag by means of corresponding heat-transmitting contacting with the ambient air flowing past.

In addition, it can be advantageous if in the case of a cooling device in accordance with the invention the cooling air duct has an air inlet for the ambient air, with the blower being arranged in the air inlet or substantially in the air inlet. The air inlet is in the simplest case an air-inlet opening, as a result of which the fluid-communicating contact between the cooling air duct and the ambient air is ensured. The blower is preferably arranged in this air inlet. This leads to a situation where there can be direct inward suction of the ambient air from the outside. Thus, so to speak, inward suction and further movement of the ambient air drawn in by suction into the cooling air duct are effected. This results in both the control or the regulation and the connection of the blower being simplified. Thus, there can be provided, for example on the outside of the housing, a control unit which can be connected to the blower in a simple and signal-communicating manner for the purposes of control or regulation. A separate energy supply for the blower at this point, for example by way of a battery or an accumulator, is of course also possible within the scope of the present invention.

It can be a further advantage if in the case of the cooling device in accordance with the invention at least one ambient-air temperature sensor is arranged for the determination of the temperature of the ambient air. As a result of the relationship of the temperature within the respiratory bag, that is, of the respiratory air, and the ambient air, a temperature difference is provided for the heat-transportation that has already been described. The greater the temperature difference between the respiratory air in the respiratory bag and the ambient air turns out to be, the greater the gradient and thus the driving force for the heat-transportation that is described is. The smaller this temperature difference turns out to be, the smaller the gradient and thus also the maximum cooling capacity that can be attained is. The provision of an ambient-air temperature sensor is thus used, for example, to adapt the volume flow of the fan. If the gradient of the heat-transportation is reduced by the reduction in the temperature difference between the ambient air and the respiratory air, preferably by means of readjustment of the blower it is possible to provide an increased volume flow. Thus, so to speak, the reduction in the gradient is compensated for at least in part by the increase in the volume flow. It can also come about that the ambient air in terms of its temperature exceeds the temperature of the respiratory air. In such a case, this can be identified by the ambient-air temperature sensor so that an undesirable reversal of the gradient and thus accompanying heat-input into the respiratory air can be effectively avoided. This happens in particular when the protective respiratory apparatus is used in particularly hot regions, for example a desert area, or in an emergency situation with a fire.

It is likewise advantageous if in the case of a cooling device in accordance with the invention at least one respiratory-air temperature sensor is arranged for the determination of the temperature of the respiratory air. This embodiment is preferably combined with the embodiment in accordance with the paragraph above. In particular, the correlation already described with regard to the gradient becomes possible as a result of the combination of an ambient-air temperature sensor and a respiratory-air temperature sensor. The respiratory-air temperature sensor is arranged, for example, within the respiratory bag and there can determine the corresponding temperature. In order in addition to obtain further information for a possible regulation or control of the blower or the cooling capacity, it can be advantageous if in addition a humidity sensor is provided within the respiratory bag. Thus, a forecast or an assessment can be made as to what extent condensation enthalpy can contribute to the cooling capacity in the case of the cooling device in accordance with the invention.

Subject-matter of the present invention is also a protective respiratory apparatus for the protection of the respiration of a person. This protective respiratory apparatus has a respiratory-air circuit and an air-reservoir connected to the respiratory-air circuit. In this case, a respiratory-air regenerator is arranged in the respiratory-air circuit. A protective respiratory apparatus in accordance with the invention is distinguished in that arranged downstream of the respiratory-air regenerator in the respiratory-air circuit there is at least one cooling device in accordance with the present invention. Accordingly, this entails a protective respiratory apparatus in accordance with the invention as explained in detail with reference to a cooling device in accordance with the invention.

Further advantages, features and details of the invention emerge from the description which follows and in which exemplary embodiments of the invention are described in detail with reference to the drawings. The features mentioned in the claims and in the description can then in each case be significant for the invention individually on their own or in any combination.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
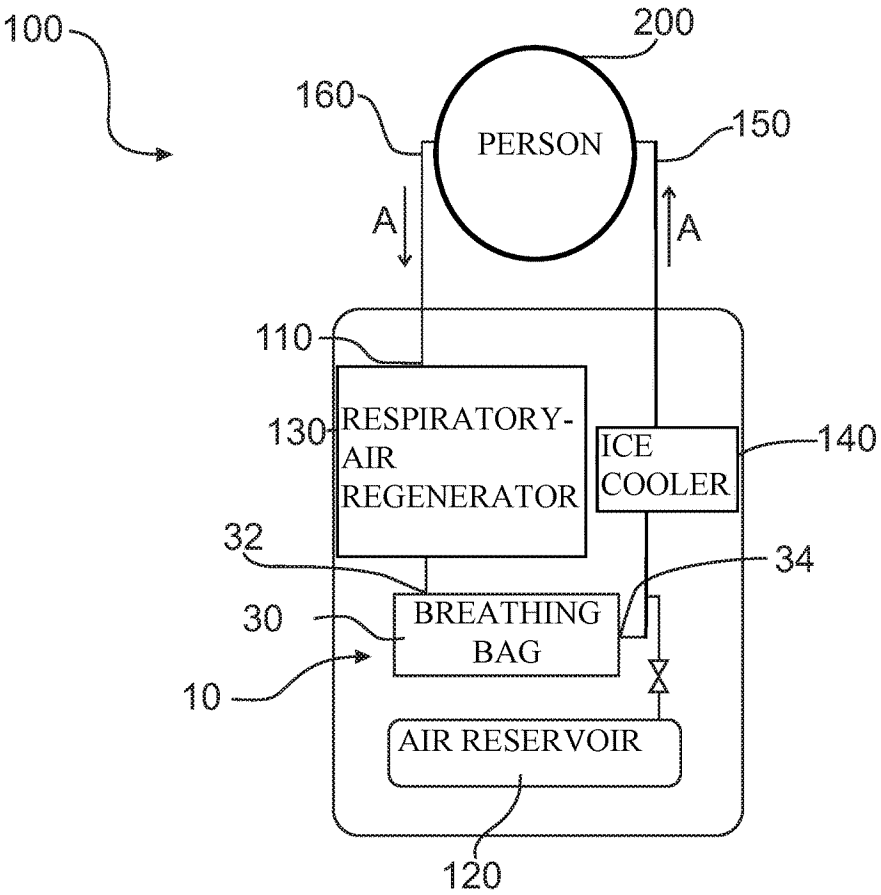
FIG. 1 is a schematic view showing an embodiment of a protective respiratory apparatus in accordance with the invention.

FIG. 1 diagrammatically shows a protective respiratory apparatus 100 in accordance with the invention. This has already been put into use by a person 200. Thus, a respiratory-air circuit 110 is provided which is described from the starting point of the person 200. When the person 200 expires air, the expired respiratory air A is introduced through an expiratory hose 160 along the respiratory-air circuit 110 into a respiratory-air regenerator 130. There, for example by means of absorption, a reduction in the $CO_2$-content is effected. This step leads to a rise in temperature of the respiratory air A and in it being loaded with moisture. Subsequently, the warmed-up respiratory air A that is loaded with moisture can enter a respiratory bag (breathing bag) 30 along the respiratory-air circuit 110 through an inlet 32. Such a respiratory bag is formed as a cooling device 10 and will be explained further later in greater detail with reference to FIGS. 2 to 4. Downstream of the respiratory bag (breathing bag) 30, which is used as a pneumatic abutment for the pneumatic function of the lungs of the person 200, the respiratory air A, which has been cooled in the cooling device 10 and preferably has reduced moisture content, exits out of an outlet 34 out of the respiratory bag 30 again. In this case fresh air or air enriched with oxygen from an air reservoir 120 can be admixed therewith by way of a valve. An additional ice cooler 140 is optionally also provided in the case of this embodiment of the protective respiratory apparatus 100 in order to be able to raise the cooling capacity further. The cooled respiratory air A now reaches the person 200 again by way of the inspiratory hose 150 and can there be inspired.

Figure 2:
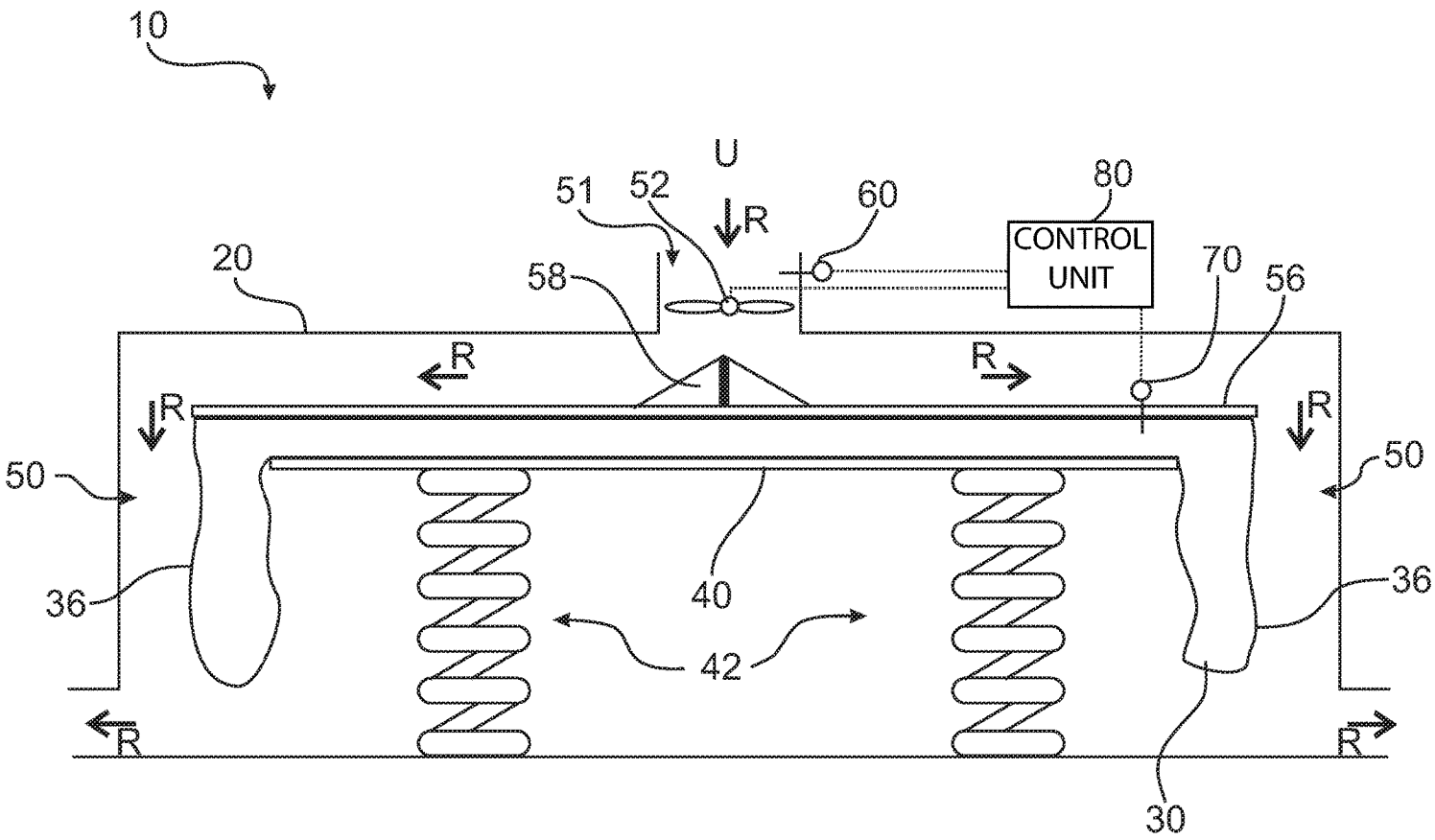
FIG. 2 is a schematic view showing an embodiment of a cooling device in accordance with the invention.
Figure 3:
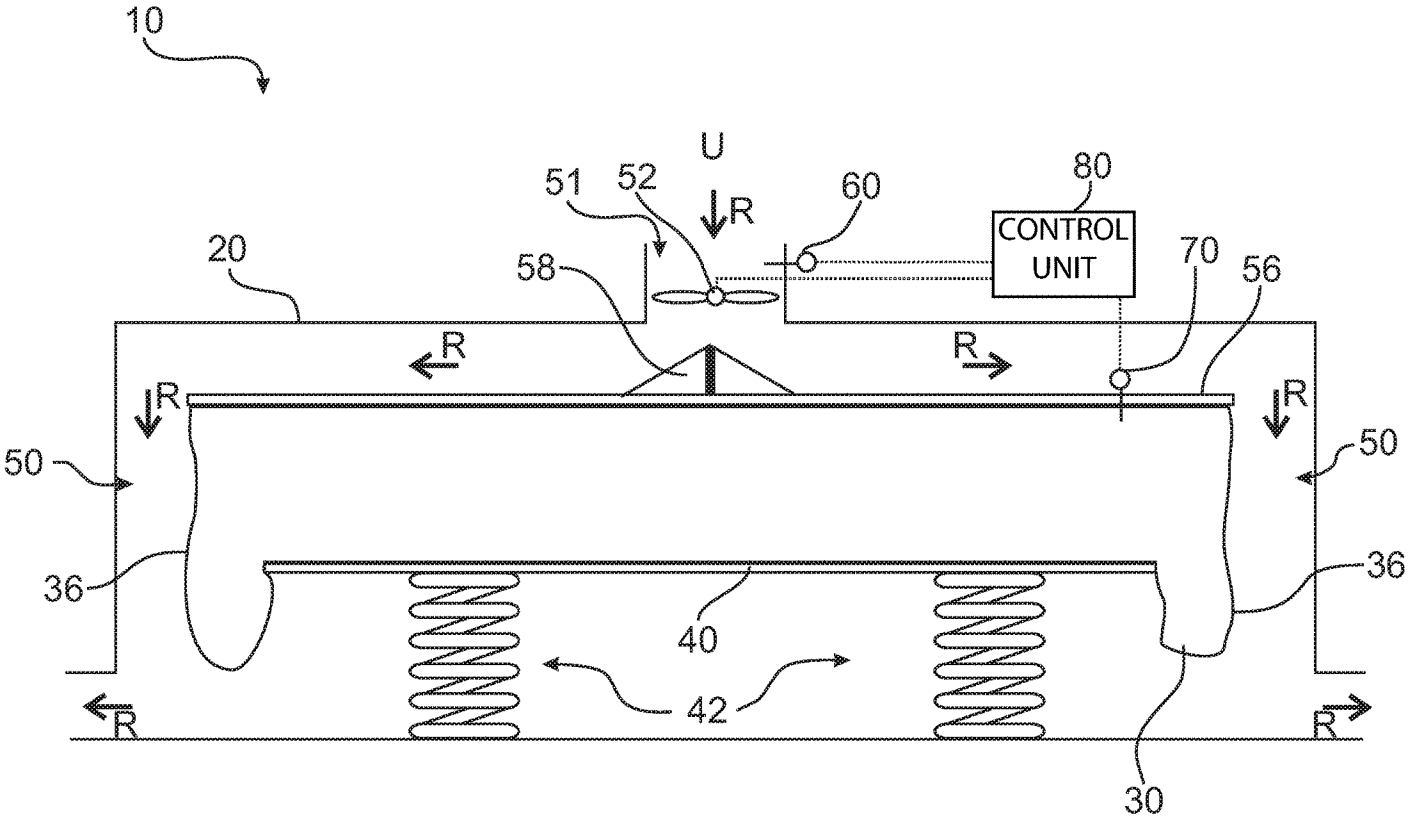
FIG. 3 is a schematic view showing the embodiment of FIG. 2 with changing volume of the respiratory bag.

An embodiment of a cooling device 10 in accordance with the invention is described with reference to FIGS. 2 and 3. A respiratory bag 30 is provided, to which a spring force can be applied by means of a spring plate 40 with a spring device 42. For this, the spring device 42 is stayed against a housing 20 of the cooling device 10. FIG. 2 shows the situation prior to the expiration of air by the person 200, whilst FIG. 3 shows the situation after the expiration. In other words, the volume of the respiratory bag 30 is enlarged during the expiration of air by the person 200 and is diminished again during the inspiration of air by the person 200. In order to be able to carry out this movement, the corresponding application of the spring force is provided by the spring device 42.

The heated-up respiratory air A which is loaded with moisture is located within the respiratory bag 30. In order to cool this air, a ventilating channel (cooling channel, cooling air duct) 50 is provided which is connected in a fluid-communicating manner with the ambient air U by means of an air inlet 51. Arranged in this air inlet 51 there is a ventilator (fan/blower) 52 which by means of a control unit 80 is supplied with energy and can be controlled or regulated. If the blower 52 moves, a flow of the ambient air U into the cooling channel 50 is generated along the respective direction of flow R of the ambient air U. Provided in the center of the cooling plate 56 that is provided there is a cooling rib 58 which is additionally formed for cooling purposes as a result of the possibility of heat-contacting heat-transmission to the surface side of the respiratory bag 30. The crucial cooling surface is, however, the outer side 36 of the respiratory bag 30. If the ambient air U has entered the cooling channel 50, it is directed to the two sides and is there guided downwards along the direction of flow R. In the case of the embodiment in accordance with FIG. 2, most air is found in this region, this air having been pressed outwards by the action with the spring force by means of the spring device 42. In this case, therefore, irrespective of the real current volume of the respiratory bag 30, the greatest quantity of air is provided, preferably under the spring pressure applied by the spring device 42. The maximum cooling capacity occurs on these outer sides 36, and this is intensified in particular by condensation on the inside of the respiratory bag 30 for the respiratory air. Subsequently, the ambient air U that is loaded in this way with heat can exit out of the housing 20 through air outlets that are not denoted specifically.

FIGS. 2 and 3 show, in addition, a sensor system with an ambient-air temperature sensor 60 and a respiratory-air temperature sensor 70. Thus, it is possible for the control unit 80 to determine the temperature gradient. Depending on the temperature gradient, accordingly a greater or a smaller volume flow can be provided in order to keep the cooling capacity as constant as possible or to compensate for a change in the gradient of the temperature between ambient air U and respiratory air A. It is also possible to achieve a timely switch-off of the blower if the temperature of the ambient air U exceeds the temperature of the respiratory air A.

Figure 4:
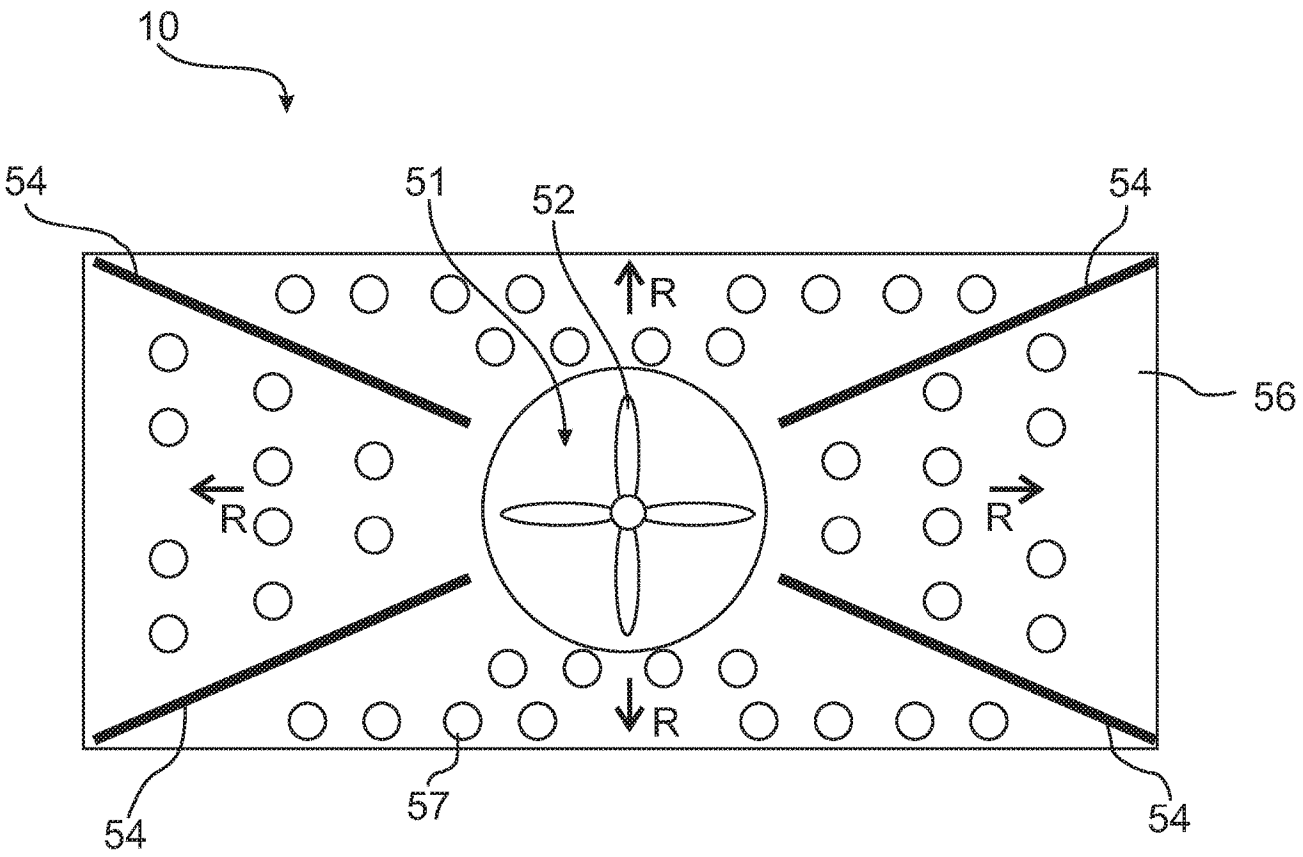
FIG. 4 is a schematic view showing a further embodiment of a cooling device in accordance with the invention.

FIG. 4 shows a further embodiment of a cooling device 10 in accordance with the invention. Thus, according to FIG. 4, a cooling plate 56 can be identified from above. The cooling plate 56 is used in a similar manner to the case of the embodiments of FIGS. 2 and 3. In contrast therewith, instead of a cooling rib 58, according to the embodiment of FIG. 4, flow-directing elements 54 in the form of directing surfaces are provided. These allow a star-shaped distribution to be enforced with a uniform fanning-out of the introduced ambient air U to all outer sides 36 of the respiratory bag 30. In addition, a plurality of cooling openings 57 is provided for improved removal of heat out of the respiratory bag 30. This perforation thus results in an aerated cooling plate 56, as shown in FIG. 4.

The explanation of the embodiments above describes the present invention exclusively within the scope of examples. Of course, individual features of the embodiments can be freely combined with each other, in so far as this is sensible, technically, without departing from the scope of the present invention. While specific embodiments of the invention have been shown and described in detail to illustrate the application of the principles of the invention, it will be understood that the invention may be embodied otherwise without departing from such principles.

The invention claimed is:

1. A cooling device for a protective respiratory apparatus, the cooling device comprising:

a housing;

a respiratory bag arranged in the housing with an inlet for respiratory air and an outlet for cooled respiratory air;

a spring plate with a spring device to apply a spring force to the respiratory bag;

a cooling channel formed between the housing and at least one section of an outer side of the respiratory bag, wherein the cooling channel is connected to ambient air outside the housing in a fluid-communicating manner; and a blower arranged at an inlet of the cooling channel for generation of a flow of the ambient air into or through or both into and through the cooling channel.

2. A cooling device according to claim 1, further comprising at least one flow-directing element arranged in the cooling channel for a targeted influence on a direction of flow of the ambient air in the cooling channel.

3. A cooling device according to claim 1, further comprising a cooling plate arranged in the housing, the cooling plate being formed as an abutment for the respiratory bag to which the spring force is applied by way of the spring plate.

4. A cooling device according to claim 3, wherein the cooling plate has at least one flow-directing element for a targeted influence on a direction of flow of the ambient air in the cooling channel.

5. A cooling device according to claim 3, wherein the cooling plate is in a heat-transmitting contact with a section of an outer side of the respiratory bag and has at least one cooling rib for a surface contact enlargement with the ambient air in the cooling channel.

6. A cooling device according to claim 3, wherein the cooling plate has at least one cooling opening which exposes the cooling channel towards an outer side of the respiratory bag.

7. A cooling device according to claim 1, further comprising at least one ambient-air temperature sensor arranged for the determination of the temperature of the ambient air.

8. A cooling device according to claim 1, further comprising at least one respiratory-air temperature sensor arranged for the determination of the temperature of the respiratory air.

9. A cooling device according to claim 3, wherein the cooling plate or the spring plate is integrated directly with the respiratory bag and takes on a sealing function at the respiratory bag.

10. A cooling device according to claim 3, wherein one of the spring plate and cooling plate is integrated into the respiratory bag.

11. A cooling device according to claim 10, wherein surfaces of the cooling plate have structural elements configured to provide additional heat conducting surfaces which improve the heat exchange between the respiratory air and the surfaces of the cooling plate or the spring plate.

12. A protective respiratory apparatus for the respiration of a person, the protective respiratory apparatus comprising:

a respiratory-air circuit;

an air reservoir connected to the respiratory-air circuit;

a respiratory-air regenerator arranged in the respiratory-air circuit; and at least one cooling device arranged downstream of the respiratory-air regenerator in the respiratory circuit the at least one cooling device comprising:

a housing;

a respiratory bag arranged in the housing with an inlet for respiratory air and an outlet for cooled respiratory air;

a spring plate with a spring device to apply a spring force to the respiratory bag;

a cooling channel formed between the housing and at least one section of an outer side of the respiratory bag, the cooling channel is connected to ambient air outside the housing in a fluid communicating manner, the at least one section of the respiratory bag being spaced from the spring plate; and a blower arranged at an inlet of the cooling channel for generation of a flow of the ambient air into or through or both into and through the cooling channel.

13. A protective respiratory apparatus according to claim 12, further comprising at least one flow-directing element in the cooling channel influencing a direction of flow of the ambient air in the cooling channel.

14. A protective respiratory apparatus according to claim 12, further comprising a cooling plate arranged in the housing, the cooling plate being formed as a support abutment for the respiratory bag to which the spring force is applied by way of the spring plate.

15. A protective respiratory apparatus according to claim 14, wherein the cooling plate is in a heat-transmitting contact with a section of an outer side of the respiratory bag and has at least one cooling rib for a surface contact enlargement with the ambient air in the cooling channel.

16. A protective respiratory apparatus according to claim 14, wherein the cooling plate has at least one cooling opening which exposes the cooling channel towards an outer side of the respiratory bag.

17. A protective respiratory apparatus according to claim 12, further comprising:

at least one ambient-air temperature sensor arranged for the determination of the temperature of the ambient air; and at least one respiratory-air temperature sensor arranged for the determination of the temperature of the respiratory air.

18. A protective respiratory apparatus according to claim 14, wherein:

the cooling plate or the spring plate is integrated directly into the respiratory bag;

surfaces of the cooling plate or the spring plate have structural elements configured to provide additional heat conducting surfaces which improve the heat exchange between the respiratory air and the surfaces of the cooling plate or the spring plate and prevent an adhesion of the side regions of the respiratory bag together or to the spring plate or the cooling plate.

19. A cooling device according to claim 1, wherein:

the ambient air is directly outside the housing;

the ambient air is separate from the respiratory air.

* * * * *